US007134527B2

(12) United States Patent
Wiggins et al.

(10) Patent No.: US 7,134,527 B2
(45) Date of Patent: Nov. 14, 2006

(54) FORKLIFT UPRIGHT ASSEMBLY

(76) Inventors: Mike Wiggins, 235 Conejo School Rd., #218, Thousand Oaks, CA (US) 91362; Liming Yue, 645 Hampshire Rd., #140, Westlake, CA (US) 91361

( * ) Notice: Subject to any disclaimer, the term of this patent is extended or adjusted under 35 U.S.C. 154(b) by 161 days.

(21) Appl. No.: 10/855,862

(22) Filed: May 26, 2004

(65) Prior Publication Data

US 2006/0016639 A1 Jan. 26, 2006

(51) Int. Cl.
*B66F 9/06* (2006.01)

(52) U.S. Cl. ..... 187/226; 187/227; 414/632

(58) Field of Classification Search ..... 187/226, 187/225, 227; 414/632
See application file for complete search history.

(56) References Cited

U.S. PATENT DOCUMENTS 4,365,693 A 12/1982 McVeen
4,392,554 A 7/1983 Russey
5,201,629 A * 4/1993 Simpson et al. ..... 414/632
5,326,217 A * 7/1994 Simpson et al. ..... 414/635
6,505,710 B1 1/2003 Kato

* cited by examiner

*Primary Examiner*—Kathy Matecki
*Assistant Examiner*—Terrell Matthews
(74) *Attorney, Agent, or Firm*—Kelly Lowry & Kelley, LLP

(57) ABSTRACT

A mast apparatus that includes a cross member assembly that permits an operator to see through portions of the assembly is provided. The cross member assembly includes upper and lower horizontal members that are slanted for general alignment with the line of sight of the operator. Moreover, some vertical stiffener members are removed thereby allowing a line of sight between the upper and lower horizontal members. To maintain structural strength, vertical stiffener members are added in the center portion and at the location of couplers or mounts for attachment to the lift hydraulic jacks.

10 Claims, 5 Drawing Sheets

FORKLIFT UPRIGHT ASSEMBLY

FIELD OF THE INVENTION

This invention relates to a lift mast assembly and more particularly to a lift mast assembly having a cross member that provides enhanced visibility for the operator.

BACKGROUND OF THE INVENTION

In the use of machinery for moving or lifting loads, it is desirable to have high operator visibility through and about the structure while using a relatively simple design. For example, a common application of such machinery involves the mast assembly for a forklift truck or other material handler. Mast assemblies often contain one or more fixed uprights attached to a vehicle with a movable upright mounted on the fixed uprights by rollers. A carriage carrying, load-engaging fork is mounted for movement on the movable uprights. The movable uprights and carriage can be selectively elevated to retrieve or place loads as desired.

In such mast assemblies the forward visibility of the operator can be restricted by the uprights and the carriage. Machinery design involving the addition of hydraulic jacks and chains which can control the movement of the uprights and carriage can be critical in that it is undesirable to further restrict the visibility or to add an additional complicated structure or weight to the vehicle.

Marina style forklifts are used for storing relatively small boats on storage racks at several lift heights. These forklifts have vertically-oriented masts that are adapted to move or tilt between a vertical orientation and a second orientation wherein the mast is tilted slightly toward the operator thereby positioning the boat more securely in a forklift. Hydraulic jacks can be attached to the mast portion of the forklifts and used to move the masts between the vertical and second orientations.

These tilt hydraulic jacks are attached to the mast portions of the forklifts by the use of structural cross members. On many marina style forklifts, there is a blind spot when the boats are raised to elevations of a certain height. This blind spot is caused by the structural cross member where the tilt hydraulic jack is attached to the mast, and can hinder an operator's view of critical portions of the boat and the fork as the operator attempts to position the boat or other loads on storage racks.

SUMMARY OF THE INVENTION

A mast apparatus that includes a cross member assembly that permits an operator to see through portions of the assembly is provided. The cross member assembly includes upper and lower horizontal members that are slanted for general alignment with the line of sight of the operator. Moreover, some vertical stiffener members are removed thereby allowing a line of sight between the upper and lower horizontal members. To maintain structural strength, vertical stiffener members are added in the center portion and at the location of couplers or mounts for attachment to the lift hydraulic jacks.

In one aspect of the invention, the mast apparatus comprises a first mast member and second mast member. A cross member assembly connects the first mast member to the second mast member and comprises an upper member or plate and a lower member or plate. The upper member extends between the first and second mast members and has an upper member upper surface and an upper member lower surface. The lower member extends between the first and second mast members and has a lower member lower surface and a lower member upper surface. The upper member lower surface defines a first imaginary plane that intersects with an imaginary horizontal plane at an angle between about 28 degrees and about 58 degrees. The lower member upper surface defines a second imaginary plane that intersects with the imaginary horizontal plane at an angle between about 20 degrees and about 50 degrees.

In another aspect, the upper member lower surface and the lower member upper surface are in a spaced-apart relationship. The cross member assembly includes at least one stiffener member connecting the upper member lower surface to the lower member upper surface.

In another aspect, the mast apparatus is adapted to move between a vertical orientation and a second orientation and is for use with a hydraulic jack. The cross member assembly further includes at least one coupler member adapted to connect to the hydraulic jack thereby permitting the hydraulic jack to move the mast apparatus between the vertical and the second orientations.

In an alternative embodiment of the invention, the mast apparatus is for use by an operator and for moving a generally horizontally-oriented, load bearing member or fork between a first elevation and a second elevation that is greater than the first elevation. The load bearing member has a proximate end adjacent to the mast apparatus and a distal end. The mast apparatus comprises a first mast member, a second mast member, and a cross member assembly. The cross member assembly connects the first mast member to the second mast member and comprises an upper member or plate and a lower member or plate, each of which extends between the first and second mast members. The upper and lower members are adapted to permit a line of sight to extend from the operator between the upper member and the lower member to the distal end of the load bearing member when the load bearing member is disposed at the second elevation.

In one aspect, the mast apparatus is adapted to move the load bearing member to a maximum elevation and the second elevation is the maximum elevation.

In another aspect, the upper member has an upper member upper surface and an upper member lower surface, and the lower member has a lower member lower surface and a lower member upper surface. The upper member lower surface defines a first imaginary plane and the lower member upper surface defines a second imaginary plane. The first and second imaginary planes are generally parallel with the line of sight.

There are additional aspects to the present inventions. It should therefore be understood that the preceding is merely a brief summary of some embodiments and aspects of the present inventions. Additional embodiments and aspects of the present inventions are referenced below. It should further be understood that numerous changes to the disclosed embodiments can be made without departing from the spirit or scope of the inventions. The preceding summary therefore is not meant to limit the scope of the inventions. Rather, the scope of the inventions is to be determined by appended claims and their equivalents.

DETAILED DESCRIPTION OF THE PREFERRED EMBODIMENT

In the following description, reference is made to the accompanying drawings which form a part hereof and which illustrate several embodiments of the present invention. It is understood that other embodiments may be utilized and structural and operational changes may be made without departing from the scope of the present invention.

Disclosed is a mast apparatus for lifting heavy loads. The mast may be of a stationary construction or may be assembled as part of a movable forklift. The mast includes a cross member for use in attaching hydraulic jacks (comprised of a cylinder and movable rod) to the mast. The cross member permits an operator to see through portions of the cross member. It includes horizontal members that are slanted for general alignment with the line of sight of the operator. Moreover, some vertical stiffener members are removed thereby allowing a line of sight between the upper and lower horizontal members. To maintain structural strength, vertical stiffener members are added in the center portion and at the location of couplers or mounts for attachment to the hydraulic jacks.

Figure 1:
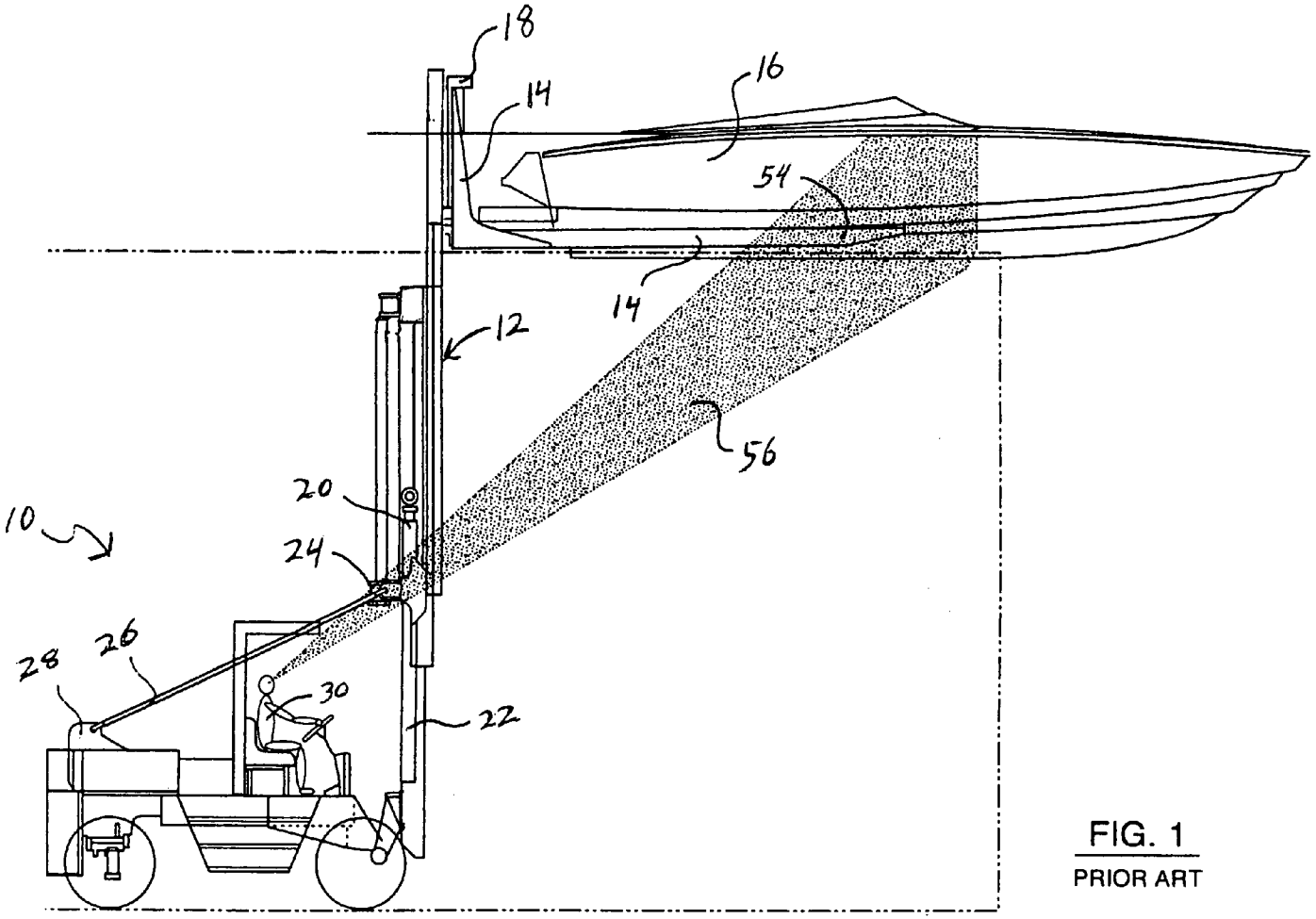
FIG. 1 PRIOR ART
FIG. 1 is a side elevation view of a marina style forklift of a known design.

Referring now to FIG. 1, there is shown a forklift 10 having a known mast assembly 12. The mast assembly includes a fork 14 that serves as a load bearing member for supporting a relatively heavy load such as a boat 16. The fork 14 is connected to a carriage 18 that is adapted to be raised and lowered by a vertically-oriented hydraulic jack 20. The hydraulic jack 20 is mounted on a stationary center guide rail assembly 22. The guide rail assembly 22 includes a cross member assembly 24 that is connected to one end of each of two tilt hydraulic jacks 26. (Only one tilt jack 26 is shown in FIG. 1.) The other end of each of the tilt hydraulic jacks 26 is connected to fixed portions 28 of the forklift 10. The tilt hydraulic jacks 26 are each comprised of a cylinder and movable rod (not shown) and are adapted to push and pull (i.e. to "tilt") the mast assembly 12 in a direction from a vertical orientation to a few degrees toward the direction of the operator 30. When the mast assembly 12 is tilted "backward" in this manner, the boat 16 may rest more securely in the fork 14 which in turn may reduce the possibility of the boat 16 falling while the forklift 10 is in motion.

Figure 3:
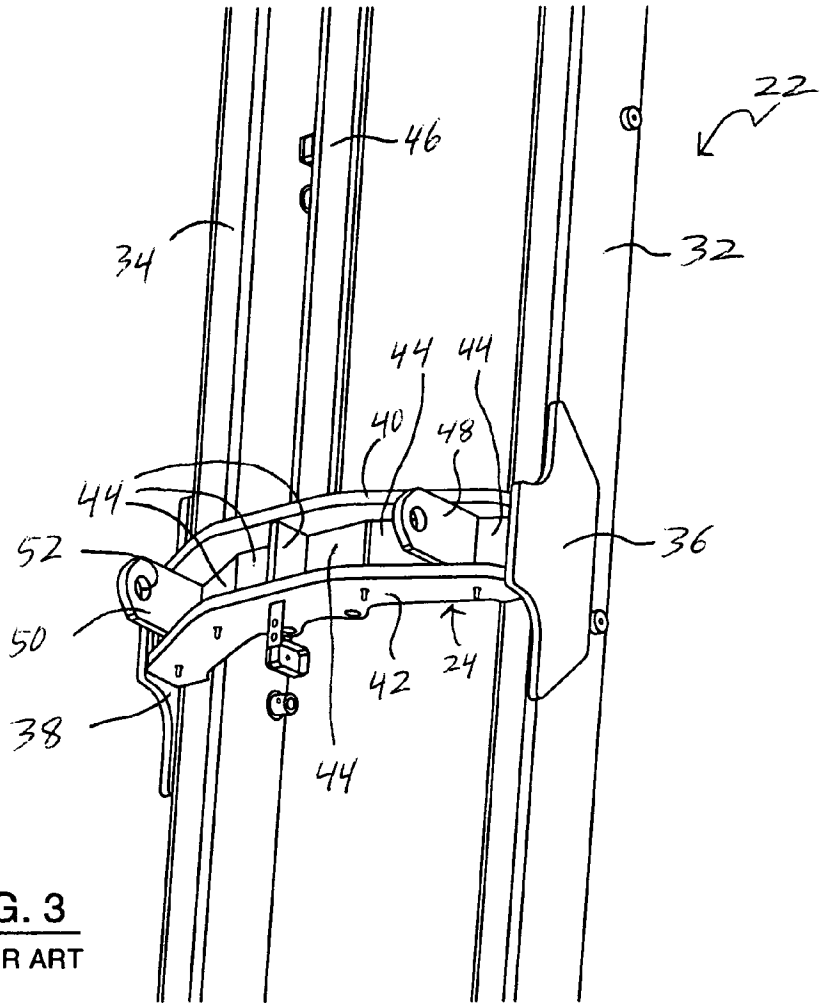
FIG. 3 PRIOR ART
FIG. 3 is a side perspective view of a portion of a center guide rail assembly of the forklift of FIG. 1.
Figure 2:
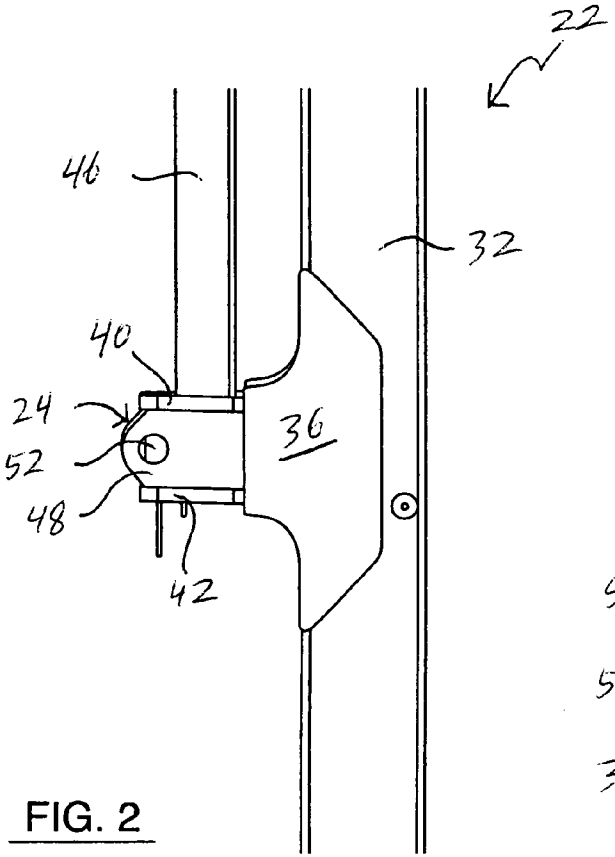
FIG. 2 PRIOR ART
FIG. 2 is a side elevation view of a portion of a center guide rail assembly of the forklift of FIG. 1.

Referring to FIGS. 2 and 3, the center guide rail assembly 22 includes a first vertically-oriented mast member 32, a second vertically-oriented mast member 34 and a vertical guide rail 46 that is disposed between portions of the first and second mast members 32, 34. The cross member assembly 24 connects the first and second mast members 32, 34 and is comprised of right and left attachment plates 36, 38 that are welded to the first mast member 32 and second mast member 34, respectively. These right and left attachment plates 36, 38 are sometimes referred to in the art as "fish plates." The cross member assembly 24 further includes a horizontally-oriented upper member 40 or plate that is connected to one end of the guide rail 46 and a horizontally-oriented lower member 42 or plate that is disposed in a parallel, spaced-apart relationship with the upper member 40. The ends of the upper and lower members 40, 42 are attached or welded to the right and left attachment plates 36, 38 thereby connecting the first and second mast members 32, 34.

A plurality of vertically-oriented stiffener members 44 are attached to the upper and lower plates 40, 42 thereby providing strength to the overall cross member assembly 24. The cross member assembly 24 further includes a right coupler 48 or mount and a left coupler 50 or mount, each of which extends inwardly in a horizontal direction. The right and left couplers 48, 50 each define a hole 52 that is adapted to receive a bolt or other connector (not shown in FIGS. 2 and 3) for connecting one end of each of the tilt hydraulic jacks 20 (FIG. 1).

As best seen in FIG. 2, the upper and lower members 40, 42 each extend horizontally and is generally perpendicular to the first and second mast members 32, 34. As best seen in FIG. 3, the area between the upper and lower members 40, 42 is "closed off" by the plurality of stiffener members 44 and by the right and left couplers 48, 50. As shown in FIG. 1 this cross member assembly 24 of known design can block the visibility of the end portion 54 of the fork 14 when the carriage 18 and fork 14 are raised to a certain elevation. The blocked field of vision is generally shown in FIG. 1 by the shaded area designated by reference numeral 56. This blocked field of vision can create difficulties for the operator 30 when positioning the boat 16 or other load for storage or other purposes.

Figure 4:
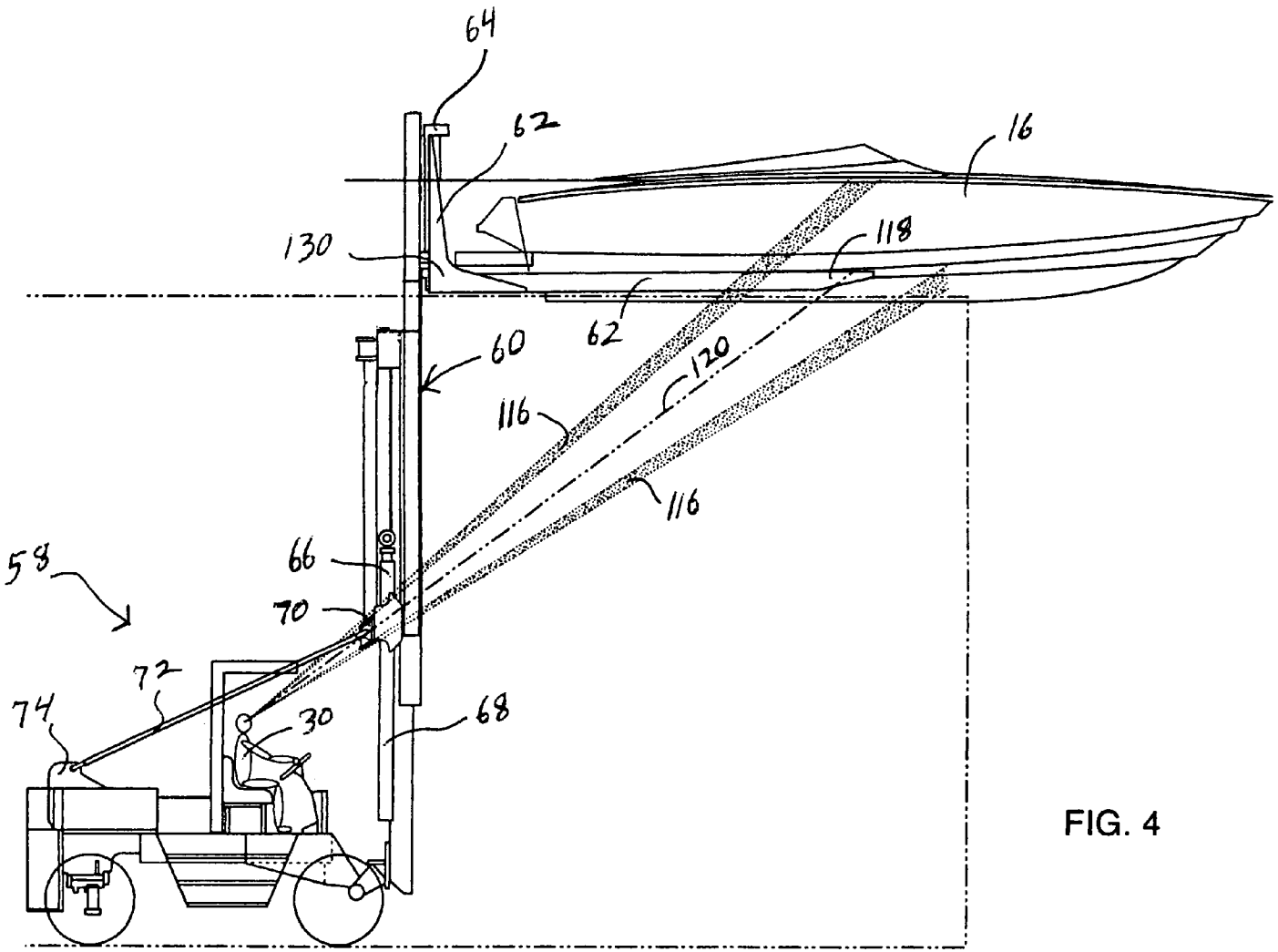
FIG. 4 is a side elevation view of a marina style forklift according to one embodiment of the invention.

Referring now to FIG. 4, there is shown a forklift 58 having a mast assembly 60 according to one embodiment of the invention. The mast assembly 60 includes a fork 62 that serves as a load bearing member for supporting a relatively heavy load such as the boat 16. The fork 62 has a distal end portion 118 and a proximate end portion 130 that is connected to a carriage 64 that in turn is adapted to be raised and lowered by a vertically-oriented, hydraulic jack 66. The hydraulic jack 66 is mounted on a stationary center guide rail assembly 68. The guide rail assembly 68 includes a cross member assembly 70 that is connected to one end of each of two tilt hydraulic jacks 72. (Only one tilt jack 72 is shown in FIG. 4.) The other end of each of the tilt hydraulic jacks 72 is connected to fixed portions 74 of the forklift 58. Each tilt hydraulic jack 72 is comprised of a cylinder and movable rod (not shown) and is adapted to push and pull (i.e. to "tilt") the mast assembly 60 in a direction from a vertical orientation to a few degrees in the direction of the operator 30. When the mast assembly 60 is tilted "backward" in this manner, the boat 16 may rest more securely in the fork 62 which in turn may reduce the possibility of the boat 16 falling while the forklift 58 is in motion.

Figure 6:
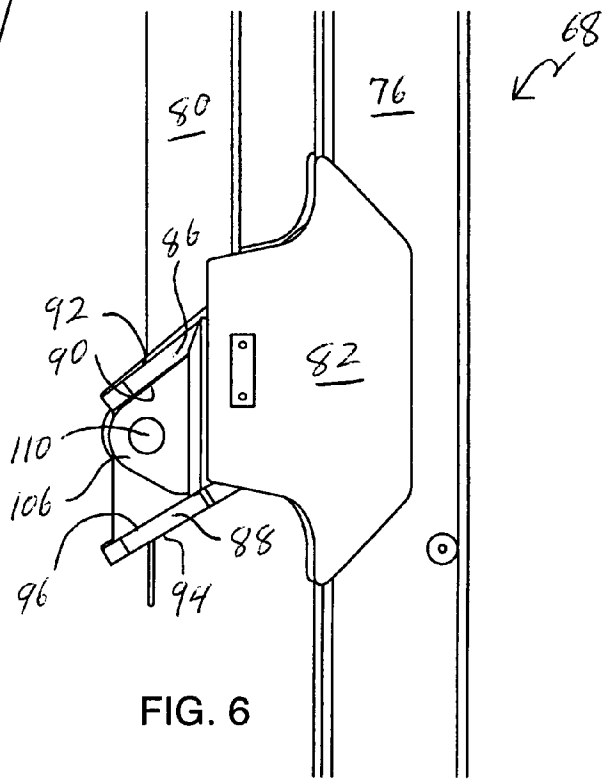
FIG. 6 is a side elevation view of a portion of the center guide rail assembly of FIG. 5.
Figure 5:
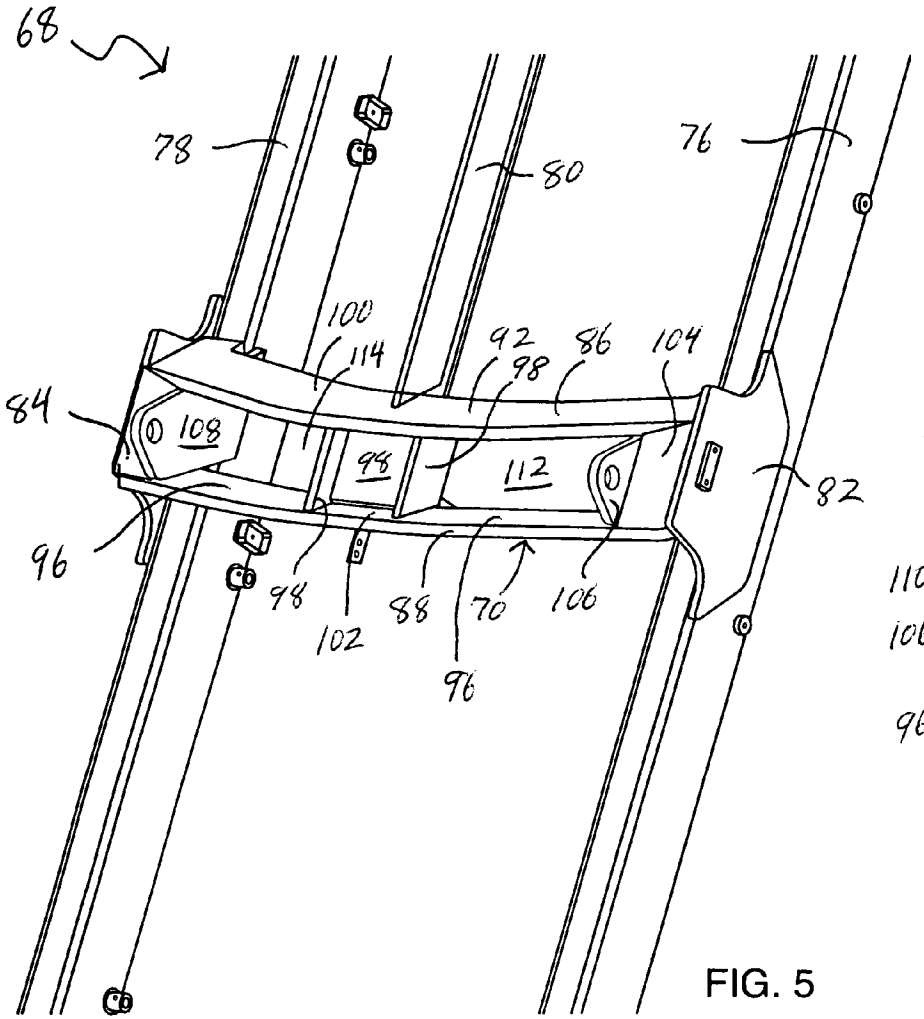
FIG. 5 is a side perspective view of a portion of a center guide rail assembly of the forklift of FIG. 4.

Referring to FIGS. 5 and 6, the center guide rail assembly 68 includes a first vertically-oriented mast member 76, a second vertically-oriented mast member 78 and a vertical guide rail 80 that is disposed between portions of the first and second mast members 76, 78. The cross member assembly 70 connects the first and second mast members 76, 78 and is comprised of a right attachment plate 82 and a left attachment plate 84 that are welded to the first mast member 76 and second mast member 78, respectively. The cross member assembly 70 further includes an upper member 86 or plate and a lower member 88 or plate that is disposed in a generally parallel, spaced-apart relationship with the upper member 86. The upper member 86 has a generally-planar lower surface 90 as well as an upper surface 92 to which one end of the guide rail 80 is attached. The lower member 88 has a lower surface 94 and a generally-planar upper surface 96. The ends of the upper and lower members 86, 88 are attached or welded to the right and left attachment plates 82, 84 thereby connecting the first and second mast members 76, 78.

A plurality of vertically-oriented stiffener members 98 are attached to the center portions 100, 102 respectively of the upper and lower members 86, 88. Two additional stiffener members 104 are attached to the end portions of the upper and lower members 86, 88. (Only one such stiffener member 104 is visible in FIG. 5.) These stiffener members 98, 104 provide strength to the overall cross member assembly 70. The cross member assembly 70 further includes a right coupler 106 or mount and a left coupler 108 or mount, each of which extends inwardly in a direction toward the operator 30. The right and left couplers 106, 108 each define a hole 110 that is adapted to receive a bolt or other connector (not shown in FIGS. 5 and 6) for connecting one end of each of the tilt hydraulic jacks 72 (FIG. 4).

As best seen in FIG. 5, the upper and lower members 86, 88, certain stiffener members 98, and the right and left couplers 106, 108 define a right opening 112 and a left opening 114 that extend through the cross member assembly 70. Although the cross member assembly 70 provides for some blockage of the operator's field of vision as shown generally by the shaded areas 116 of FIG. 4, the right and left openings 112, 114 permit a line of sight 120 to extend from the operator 30 between the upper member 86 and lower member 88 to the end portion 118 of the fork 62 when the fork 62 is at a predetermined elevation.

Figure 7:
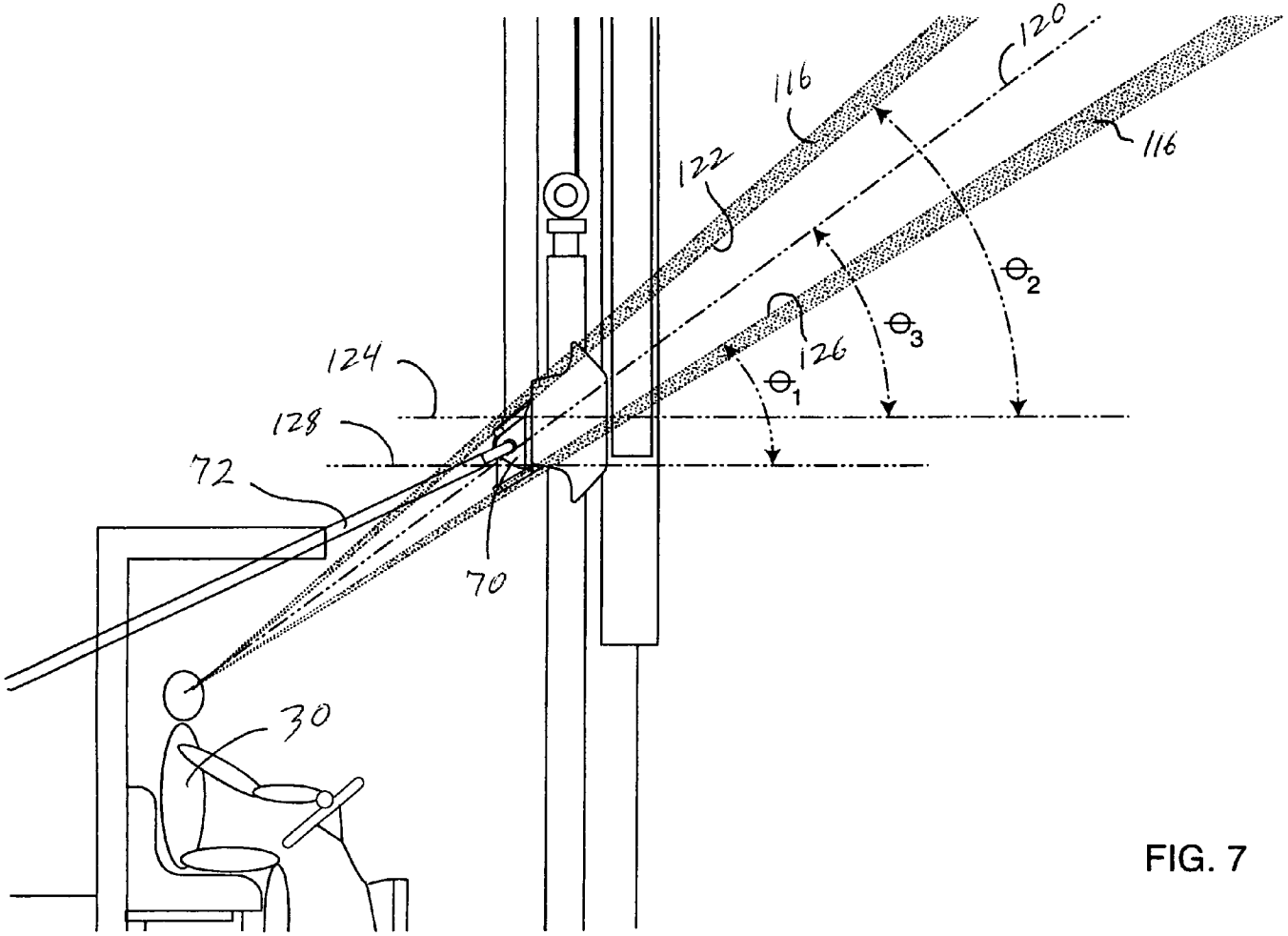
FIG. 7 is a side elevation view of a portion of the marina style forklift of FIG. 4.

Referring to FIGS. 6 and 7, the upper and lower members 86, 88 are tilted or oriented downward from the horizontal in a direction generally pointing to the operator 30. The upper member lower surface 90 defines an upper imaginary plane 122 that intersects with an imaginary horizontal plane 124 at an angle shown in FIG. 7 designated by $\Theta_2$. In the embodiment of FIG. 7, $\Theta_2$ is about 39°. In alternative embodiments, however, $\Theta_2$ can be any angle between about 28° and about 58°.

The lower member upper surface 96 defines a lower imaginary plane 126 that intersects with an imaginary horizontal plane 128 at an angle shown in FIG. 7 designated by $\Theta_1$. In the embodiment of FIG. 7, $\Theta_1$ is about 31°. In alternative embodiments, however, $\theta_1$ can be any angle between about 20° and about 50°. In yet another embodiment of the invention, the upper imaginary plane 122 and lower imaginary plane 126 are generally parallel with the line of sight 120 between the operator 30 and the end portion 118 of the fork 62.

Thus there is disclosed a mast apparatus that includes a cross member assembly that permits an operator to see through portions of the assembly. The cross member assembly includes upper and lower horizontal members that are slanted for general alignment with the line of sight of the operator. Moreover, some vertical stiffener members are removed thereby allowing a line of sight between the upper and lower horizontal members. To maintain structural strength, vertical stiffener members are added in the center portion and at the location of couplers or mounts for attachment to the lift hydraulic jacks.

While the description above refers to particular embodiments of the present invention, it will be understood that many modifications may be made without departing from the spirit thereof. The claims are intended to cover such modifications as would fall within the true scope and spirit of the present invention. The presently disclosed embodiments are therefore to be considered in all respects as illustrative and not restrictive, the scope of the invention being indicated by the claims rather than the foregoing description, and all changes which come within the meaning and range of equivalency of the claims are therefore intended to be embraced therein.

What is claimed is:

1. A mast apparatus, comprising:

a first mast member;

a second mast member; and a cross member assembly connecting the first mast member to the second mast member, said cross member assembly comprising:

an upper member extending between the first and second mast members, said upper member having an upper member upper surface and an upper member lower surface; and a lower member extending between the first and second mast members said lower member having a lower member lower surface and a lower member upper surface;

wherein the upper member lower surface defines a first imaginary plane that intersects with an imaginary horizontal plane at an angle between about 28 degrees and about 58 degrees when the first and second mast members are vertically oriented; and wherein the lower member upper surface defines a second imaginary plane that intersects with the imaginary horizontal plane at an angle between about 20 degrees and about 50 degrees when the first and second mast members are vertically oriented; and wherein the upper member lower surface and the lower member upper surface are in a spaced-apart relationship, and wherein the cross member assembly further comprises at least one stiffener member connected the upper member lower surface to the lower member upper surface; the upper member, the lower member, and the at least one stiffener member defining an opening that extends through the cross member assembly.

2. The apparatus of claim 1, wherein the first imaginary plane intersects the imaginary horizontal plane at an angle of about 39 degrees and wherein the second imaginary plane intersects the imaginary horizontal plane at an angle of about 31 degrees.

3. The apparatus of claim 1, wherein the mast apparatus is adapted to move between a vertical orientation and a second orientation, wherein the mast apparatus is for use with a hydraulic jack, and wherein the cross member assembly further comprises at least one coupler member adapted to connect to the hydraulic jack thereby permitting the hydraulic jack to move the mast apparatus between the vertical and the second orientations.

4. The apparatus of claim 3, wherein the upper member lower surface and the lower member upper surface are in a spaced-apart relationship, and wherein the cross member assembly further comprises at least one stiffener member connecting the upper member lower surface and the lower member upper surface; the upper member, the lower member, and the at least one stiffener member defining an opening that extends through the cross member assembly.

5. A mast apparatus for use by an operator and for moving a generally horizontally-oriented load bearing member between a first elevation and a second elevation that is greater than the first elevation, said load bearing member having a proximate end adjacent to the mast apparatus and a distal end, the mast apparatus comprising:

a first mast member;

a second mast member; and a cross member assembly connecting the first mast member to the second mast member, said cross member assembly comprising:

an upper member extending between the first and second mast members; and a lower member extending between the first and second mast members wherein the upper member and the lower member permit a line of sight to extend from the operator when seated in an operating position between the upper member and the lower member to the distal end of the load bearing member when the load bearing member is disposed at the second elevation, wherein the upper member has an upper member upper surface and an upper member lower surface, wherein the lower member has a lower member lower surface and a lower member upper surface, wherein the upper member lower surface defines a first imaginary plane and the lower member upper surface defines a second imaginary plane, and wherein the upper member lower surface and the lower member upper surface are adapted to permit the line of sight to extend from the operator between the upper member lower surface and the lower member upper surface to the distal end of the load bearing member when the load bearing member is disposed at the second elevation; and wherein the upper member lower surface and the lower member upper surface are in a spaced-apart relationship, and wherein the cross member assembly further comprises at least one stiffener member connected the upper member lower surface to the lower member upper surface; the upper member, the lower member, and the at least one stiffener member defining an opening that extends through the cross member assembly.

6. The apparatus of claim 5, wherein the mast apparatus is adapted to move the load bearing member to a maximum elevation and wherein the second elevation is the maximum elevation.

7. The apparatus of claim 5, wherein the mast apparatus is adapted to move between a vertical orientation and a second orientation, wherein the mast apparatus is for use with a hydraulic jack, and wherein the cross member assembly further comprises at least one coupler member adapted to connect to the hydraulic jack thereby permitting the hydraulic jack to move the mast apparatus between the vertical and the second orientations.

8. The apparatus of claim 5, wherein the first and second imaginary planes are generally parallel with the line of sight.

9. The apparatus of claim 5, wherein the mast apparatus is adapted to move the load bearing member to a maximum elevation and wherein the second elevation is the maximum elevation.

10. The apparatus of claim 9, wherein the first and second imaginary planes are generally parallel with the line of sight.

* * * * *